US006425768B1

(12) United States Patent
Taylor

(10) Patent No.: US 6,425,768 B1
(45) Date of Patent: Jul. 30, 2002

(54) CLAMP CONNECTOR ASSEMBLY

(75) Inventor: Paul R. Taylor, Mechanicsburg, PA (US)

(73) Assignee: InterCon Systems, Inc., Harrisburg, PA (US)

( * ) Notice: Subject to any disclaimer, the term of this patent is extended or adjusted under 35 U.S.C. 154(b) by 0 days.

(21) Appl. No.: 09/716,103

(22) Filed: Nov. 17, 2000

(51) Int. Cl.[7] ..... H01R 9/09
(52) U.S. Cl. ..... 439/67; 439/331
(58) Field of Search ..... 439/67, 331, 493; 361/704

(56) References Cited

U.S. PATENT DOCUMENTS

| | | | | | |
|---|---|---|---|---|---|
| 4,109,987 | A | | 8/1978 | Bourdon | 339/75 |
| 4,420,203 | A | | 12/1983 | Aug et al. | 339/17 |
| 4,602,317 | A | | 7/1986 | Rovnyak et al. | 361/413 |
| 4,647,125 | A | * | 3/1987 | Landi et al. | 439/67 |
| 4,683,423 | A | | 7/1987 | Morton | 324/158 |
| 4,824,392 | A | | 4/1989 | Billman et al. | 439/331 |
| 4,902,234 | A | | 2/1990 | Brodsky et al. | 439/67 |
| 4,927,369 | A | | 5/1990 | Grabbe et al. | 439/66 |
| 4,948,374 | A | * | 8/1990 | Cater | 439/67 |
| 4,975,068 | A | | 12/1990 | Squires | 439/67 |
| 5,059,129 | A | | 10/1991 | Brodsky et al. | 439/67 |
| 5,068,601 | A | * | 11/1991 | Parmenter | 439/331 |
| 5,099,393 | A | | 3/1992 | Bentlage et al. | 361/413 |
| 5,228,863 | A | | 7/1993 | Campbell et al. | 439/67 |
| 5,259,781 | A | * | 11/1993 | Baumberger et al. | 439/67 |
| 5,310,352 | A | | 5/1994 | Mroczkowski et al. | 439/76 |
| 5,362,247 | A | | 11/1994 | Rodriguez | 439/330 |
| 5,468,158 | A | | 11/1995 | Roebuck et al. | 436/264 |
| 5,468,917 | A | | 11/1995 | Brodsky eet al. | 174/255 |
| 5,468,996 | A | | 11/1995 | Chan et al. | 257/723 |
| 5,530,291 | A | | 6/1996 | Chan et al. | 257/723 |
| 5,571,027 | A | | 11/1996 | Roebuck | 547/264 |
| 5,575,662 | A | | 11/1996 | Yamamoto et al. | 439/67 |
| 5,588,866 | A | | 12/1996 | Rothenberger | 439/372 |
| 5,691,041 | A | | 11/1997 | Frankeny | 428/209 |
| 5,741,141 | A | | 4/1998 | O'Malley | 439/73 |
| 5,766,022 | A | | 6/1998 | Chapin | 439/73 |
| 5,770,891 | A | | 6/1998 | Frankeny | 257/727 |
| 5,793,546 | A | | 8/1998 | Chan | 361/809 |
| 5,899,757 | A | | 5/1999 | Neidich et al. | 439/67 |
| 5,919,050 | A | | 7/1999 | Kehley et al. | 439/71 |
| 5,947,750 | A | | 9/1999 | Alcoe et al. | 439/67 |
| 5,997,316 | A | | 12/1999 | Kunzel | 439/73 |
| 6,022,225 | A | | 2/2000 | Chapin | 439/73 |
| 6,036,502 | A | | 3/2000 | Neidich et al. | 439/67 |
| 6,056,581 | A | | 5/2000 | Rothenberger | 439/372 |
| 6,077,090 | A | | 6/2000 | Campbell et al. | 439/67 |
| 6,201,697 | B1 | * | 3/2001 | McCullough | 361/704 |

* cited by examiner

*Primary Examiner*—Brian Sircus
*Assistant Examiner*—P. Dinh
(74) *Attorney, Agent, or Firm*—Thomas Hooker, P.C.

(57) ABSTRACT

A clamp connector assembly for forming a plurality of electrical connections between two circuit members includes a bottom plate below the circuit members, two retention posts extending upwardly from the bottom plate and through holes in a top plate above the circuit members, two rotary clamp members mounted on the upper ends of the retention posts with offset arms extending outwardly from the posts to facilitate manual rotation of the clamp members and actuation of assembly closing connections between the members and the top plate to force the top plate toward the bottom plate, clamp the circuit members together and form electrical connections between the circuit members.

37 Claims, 7 Drawing Sheets

CLAMP CONNECTOR ASSEMBLY

FIELD OF THE INVENTION

The invention relates to clamp connector assemblies for forming releasable electrical connections between contact pads on circuit members. The circuit members may be rigid, such as circuit boards or substrates or flexible, such as ribbon cables.

DESCRIPTION OF THE PRIOR ART

Clamp connector assemblies for forming releasable connections between flexible and rigid circuit members are well known. The assemblies conventionally include a clamp and an elastomer pad. The clamp biases two circuit members together to form electrical connections between pairs of contact pads on the circuit members. A flexible circuit member may directly overly a rigid or flexible circuit member so that the pads on the circuit members contact each other. An elastomer pad overlying the flexible circuit member is compressed to form the electrical connections. Alternatively, the circuit members may be located on opposite sides of an interposer assembly which is compressed by the clamp to form electrical connections between opposed pairs of contact pads. The interposer assembly may include elastomer pads. Clamp connector assemblies form electrical connections between two circuit boards, a circuit board and a flexible circuit member or two flexible circuit members.

Conventional clamp connectors have a bottom plate, a pair of retention posts extending upwardly from the bottom plate, a top plate and a mechanism engaging the ends of the posts to move the top plate toward the bottom plate to form electrical connections between circuit members held between the plates. The circuit members, and an interposer assembly, if used, are clamped between the two plates. Threaded screw type closing mechanisms typically move the top plate toward the bottom plate, clamp the two circuit members together and form desired electrical connections.

Modern circuit elements have very densely spaced contact pads. Connector assemblies for forming connections between the assemblies are correspondingly small, yet require relatively high contact pressure in order to assure a sufficient contact force is applied to each pair of contact pads on the circuit members to form reliable electrical connections. This means that relatively high force is required to form the electrical connections. Manual actuation of the clamp is difficult due to the small size of the assemblies and the relatively high actuation forces required. Further, uniform contact pressure must be maintained at each pair of contact pads on the circuit members. The pads are spaced on the surfaces of the circuit members, conventionally in side-by-side rows. In order to assure uniform pressure connections, the clamp used to hold the circuit members together must provide uniform contact pressure to each of the large number of contact pad pairs independent of the location of the contact pads on the circuit members.

The contact pressure required to close conventional clamp assemblies to form electrical connections may be provided by two threaded members engaging two retention posts. Simultaneous manual engagement of threaded members is difficult, particularly where high torque is required to rotate threaded members to form the electrical connections.

Conventional clamp connector assemblies for forming connections between contact pads on a flexible circuit member, typically a ribbon cable, and contact pads on a rigid circuit member, typically a circuit board, include a clamp and a housing joined to a flexible circuit member with an elastomer pad held between the housing and the flexible circuit member. When the assembly is closed, the elastomer pad biases contact pads on the flexible circuit member away from the housing against contact pads on the rigid circuit member to form electrical connections. Manufacture of this type of clamp connector assembly is facilitated by making a subassembly including the housing, elastomer pad, and the flexible circuit member with the circuit member permanently mounted to the bottom of the housing and the pad is confined in a recess in the housing between the circuit member and the plate. The subassembly, together with a bottom plate and retention posts, elastomer mat and clamp members, is shipped to an end user for mounting on a rigid circuit member with bottom plate and mat on the lower side of the rigid circuit member, the retention posts extending through holes in the rigid circuit member and the subassembly and the clamp members engaging the upper ends of the retention posts to compress the elastomer pad, bias the flexible circuit member against the rigid circuit member and form the electrical connections.

It is important that the flexible circuit member be maintained in a flat, planar position on the housing in the subassembly. Outward bowing of the flexible circuit member overlying the elastomer pad produces undesired ripples in the flexible circuit member. The ripples extend along the flexible circuit member an appreciable distance away from the subassembly and can stress the member and prevent proper routing of the member. Rippling of the flexible member in the subassembly occurs because the uncompressed elastomer pad has a thickness greater than the depth of the recess in the housing and extends out of the housing and pushes or bows the flexible circuit member outwardly from the desired flat portion overlying the housing.

Therefore, there is a need for an improved manually closed clamp connector assembly for forming electrical connections between circuit members. The clamp assembly should be easily closed and opened by an operator yet assure reliable pressure electrical connections between large numbers of opposed pairs of contact pads. After closing, the assembly should be compact without the closing mechanism extending beyond the perimeter of the assembly.

There is also a need for an improved clamp connector assembly for forming connections between a flexible circuit member and another circuit member where the assembly simultaneously forms a large number of electrical connections by pressing an elastomer pad against the flexible circuit member without distortion of the flexible circuitry before or during clamping.

SUMMARY OF THE INVENTION

The invention is an improved clamp connector assembly for forming electrical connections between two circuit members. The circuit members may be rigid or flexible. Two connector assemblies are disclosed. A first embodiment clamp connector assembly includes an interposer and forms electrical connections between two rigid or flexible circuit members. The second embodiment clamp connector assembly forms electrical connections between a first flexible circuit member and a second circuit member, which may be rigid or flexible.

Both connector assembly embodiments include an improved manual clamp in which the circuit members to be joined are positioned between a bottom plate and a top plate and manually rotatable clamp members are fitted on the ends of retention posts extending up from a bottom plate and through holes in a top plate. The clamp members include elongate, offset and force multiplying arms extending from opposite sides of the top plate. The arms are manually rotated to closed, compact positions overlying the top of the top plate. Rotation of the arms cams the top plate toward the bottom plate to sandwich the circuit members between the plates and form electrical connections between pads on the two circuit members. During and following clamping, the top plate is maintained parallel to the bottom plate to assure uniform contact pressure is exerted on all pairs of contact pads. The clamp members are easily mounted on and removed from the retention posts.

In the first embodiment clamp connector assembly, the two circuit members are mounted on the retention posts with an interposer assembly positioned between the members. The interposer assembly is resilient to assure proper pressure electrical connections are formed between contacts on opposite sides of the assembly and contact pads on the circuit members.

In the second embodiment clamp connector assembly, a flexible circuit member is positioned on top of contact pads on a rigid or flexible circuit member and a housing is positioned on top of the flexible circuit. The housing carries an elastomer pad overlying the contacts on the flexible circuit member. The two circuit members and the housing are positioned between the clamp top plate and bottom plate. Manual clamp members are attached to the ends of the retention posts extending above the top plate and then rotated to cam the top plate toward the bottom plate to form the desired electrical connections.

The second embodiment assembly includes a subassembly including the flexible circuit member, the housing, the elastomer pad and the top plate. The subassembly may be manufactured as a unit for shipment to the user together with the remaining parts of the second embodiment assembly. During manufacture, the flexible circuit member is permanently mounted on the housing flat, without ripples, and the pad and top plate are mounted in the housing. The top plate and pad are loosely confined in the housing so that the pad does not flex the flat flexible circuit.

Both connector assembly embodiments form reliable electrical connections between a large number of contact pads on two circuit members. These connections are readily releasable by manually rotating the cam members back to the initial positions, with the arms extending outwardly from the top plate. When in this position, the two circuit members may be disengaged by removing the components of the assembly from the retention posts extending from the bottom plate.

Other objects and features of the invention will become apparent as the description proceeds, especially when taken in conjunction with the accompanying drawings illustrating the invention, of which there are seven sheets of drawings and two embodiments are disclosed.

DESCRIPTION OF THE PREFERRED EMBODIMENTS

Figure 1:
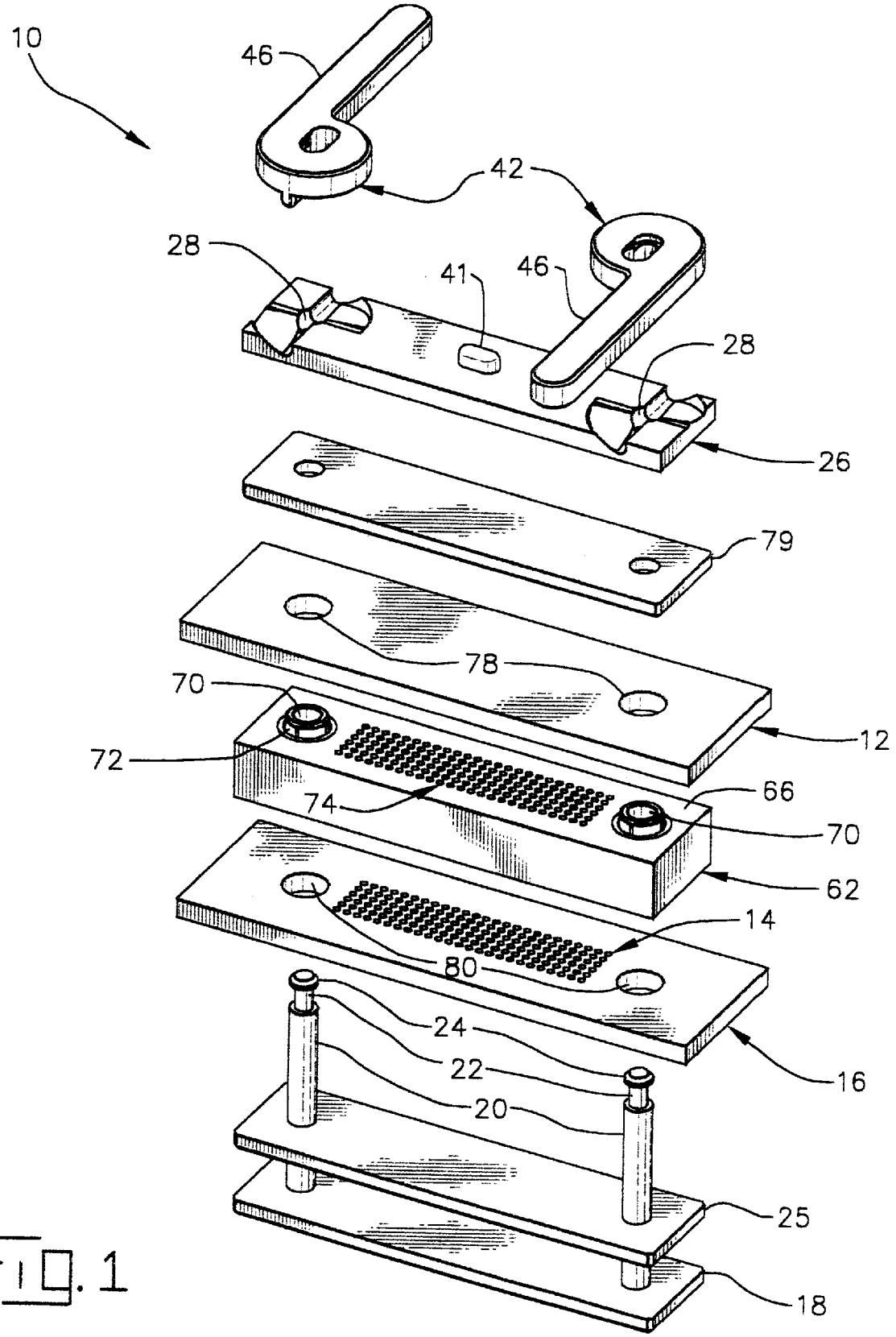
FIG. 1 is an exploded view of a first embodiment clamp connector assembly according to the invention.

First embodiment clamp connector assembly 10 is illustrated in FIGS. 1–7 of the drawings. Connector assembly 10 forms electrical connections between rows of contact pads (not illustrated) on the lower surface of flat circuit member 12 and corresponding rows of contact pads 14 on the upper surface of flat circuit member 16. The circuit members 12 and 16 may be circuit boards, flexible ribbon cables, flexible circuit members, substrates or the like and may have different shapes than illustrated members 12 and 16.

Assembly 10 includes an elongate, flat bottom plate 18 with a pair of retention posts 20 extending upwardly from opposite ends of the plate. Reduced diameter portions 22 are formed on the upper ends of the posts inwardly of end collars 24. Posts 20 extend through holes formed in the opposite ends of an elastomer compliance mat 25. The mat rests on plate 18 when assembly 10 is closed. The mat is formed from a compressible elastomer which may be silicone rubber.

Figure 3:
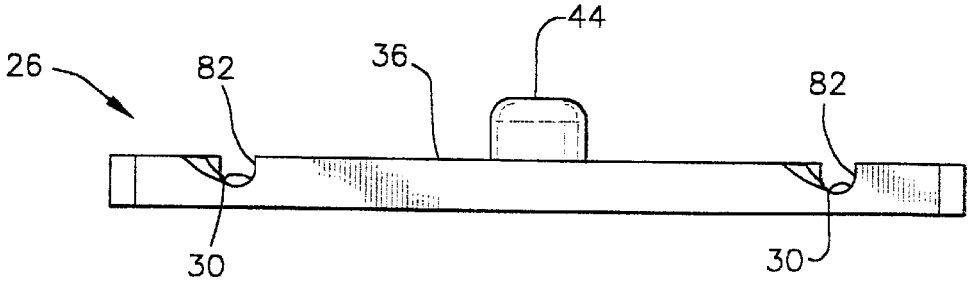
Figure 4:
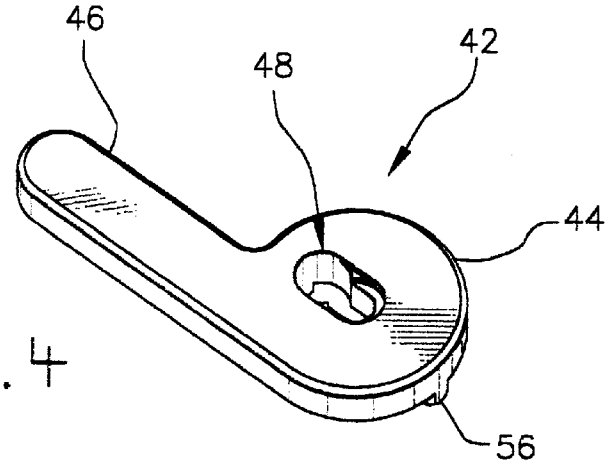
FIGS. 4–7 are perspective, top, side and bottom views respectively of a clamp member.
Figure 5:
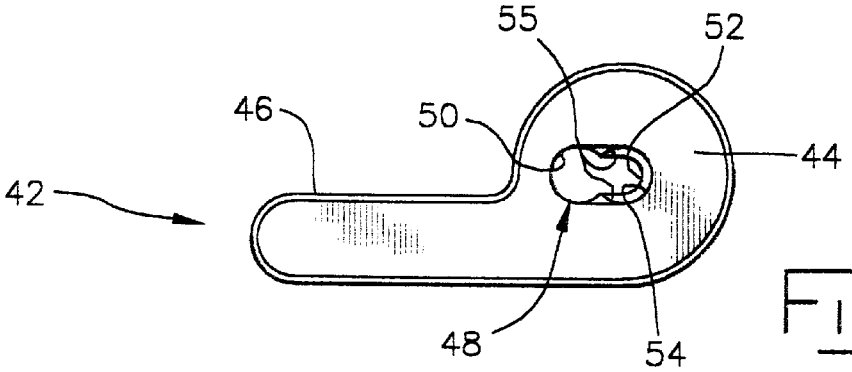
Figure 6:
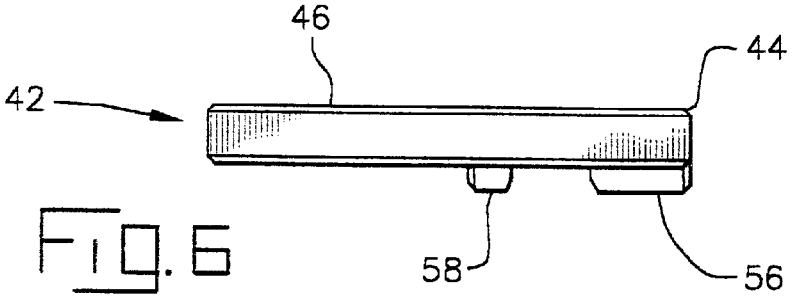
Figure 7:
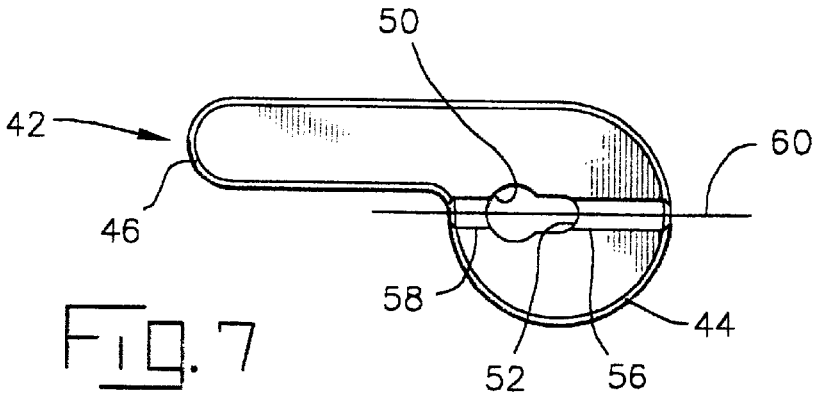

Elongate, flat top plate 26 overlies and may be the same shape as bottom plate 18. A pair of post holes 28 extend through the ends of plate 26 for receiving the upper ends of posts 20. A groove 30 is formed in the top surface 36 of the plate and extends across the width of the plate at each hole 28. As illustrated in FIG. 3, the grooves 30 are recessed below top surface 36. A pair of retention grooves 38 extend along the length of plate 26 at each hole, perpendicular to grooves 30. Grooves 30 and 38 extend across the centers of the holes 28, and each includes radial segments on opposite sides of the hole. Grooves 38 extend into plate top surface 36 a shallow distance and are above grooves 30.

Two ninety degree cam surfaces 40 slope up in a clockwise direction from the segments of each groove 30 to adjacent segments of groove 38. The cam surfaces have a constant slope between the groove segments to facilitate closing of assembly 10. Manual grip and arm stop member 41 projects upwardly from the center of plate 26.

The connector assembly 10 includes a pair of like clamp members 42. Each member includes a flat, generally circular mounting portion 44 and an elongate, offset arm 46 extending from one side of the mounting portion. An elongate opening 48 extends through the thickness of portion 44 and includes a cylindrical insertion portion 50, dimensioned to have a close fit with the collar 24 of post 20, and a reduced diameter lock portion 52 dimensioned to have a close fit with the reduced diameter portion 22 of post 20.

Retention groove 54 is C-shaped and extends around the top of lock portion 52. The groove is dimensioned to receive a post end collar 24. Groove 54 extends more than 180 degrees around the lock portion to lock the clamp member 42 on a post 20 with reduced diameter portion 22 in lock portion 52 and collar 24 in groove 54. The end portions 55 of grooves 54 are spaced apart a distance less than the diameter of collars 24. When the collars are seated in the grooves the clamp members are rotatably mounted on the upper ends of posts 20.

Follower ridges 56 and 58 extend below the lower surface of the clamp member. The ridges lie on an axis 60 extending through the rotational center of a retention post 20 when the clamp member is mounted on the post with the reduced diameter portion 22 in lock portion 52 and collar 24 seated in groove 54. The insertion and lock portions 50, 52 of opening 48 are spaced apart along axis 60 with lock portion 52 in the center of mounting portion 44. Ridge 56 extends from the lock portion 52 to the edge of the mounting portion. Ridge 58 is shorter than ridge 56, and extends from insertion portion 50 to the edge of the mounting portion. Arm 46 is offset to one side of axis 60 and extends away from the mounting portion parallel to axis 60.

Interposer assembly 62 includes an elongate body 64 having opposed parallel upper and lower faces 66 and 68 and cylindrical mounting passages 70 extending through the ends of the body between the upper and lower faces. Alignment collars 72 surround the passages and project outwardly of the faces.

Rows of closely spaced electrical contacts are provided on the upper and lower faces of the assembly. Contacts 74 on upper face 66 are shown in FIG. 1. The contacts on the lower face are not illustrated. Assembly 62 includes an electrical connection extending from each contact on the upper face to a corresponding contact on the lower face. The electrical connections are not illustrated. These connections may be formed by a short length of flexible ribbon cable wrapped around the interposer assembly. Additionally, the assembly includes two resilient elastomer pads 76, shown in FIG. 1B. The pads 76 bias the interposer contacts against corresponding contact pads on circuit members 12 and 16 to form electrical connections between the contact pads on the circuit members. Pads 76 may be formed of silicone rubber.

The closely spaced contact pads (not illustrated) on the lower surface of circuit member 12 form electrical connections with contacts 74 on the upper surface of assembly 62. The closely spaced electrical contact pads 14 on the upper face of circuit member 16 form electrical connections with the contacts on the lower face of assembly 62 (not illustrated). Upper circuit member 12 includes a pair of alignment holes 78 located to either side of the contact pads on the lower face of the member. The lower circuit member 16 includes a pair of alignment holes 80, like holes 78, located to either side of contact pads 14.

Flat elastomer mat 79 is located between circuit member 12 and top plate 26. The upper ends of posts 20 extend through holes formed through the ends of mat 79. The mat may be formed from silicone rubber.

Plates 18 and 26, posts 20 and clamp members 42 are preferably formed from metal. Body 64 of interposer assembly 62 is formed from an insulating material, which may be molded thermoplastic resin. If desired, mat 25 may be adhesively bounded to bottom plate 18 and mat 79 may be adhesively bonded to top plate 26. Alternatively, mat 25 may be adhesively bonded to circuit board 16 and mat 79 may be adhesively bonded to circuit board 12.

Electrical connections between the pads on circuit members 12 and 16 are made by extending posts 20 on plate 18 through the holes in mat 25, holes 80 in circuit member 16, passages 70 in interposer assembly 62, holes 78 in upper circuit member 12, the holes in mat 79 and holes 28 in top plate 26. With these members in place and resting on plate 18, the reduced diameter portions 22 of posts 20 extend above top plate 26.

Clamp members 42 are mounted on the exposed ends of posts 20 by positioning the two members as shown in FIG. 1 with arms 46 extending away from the sides of the top plate and with the insertion portions 50 of openings 48 located above and in axial alignment with the posts. The members are then moved downwardly over the upper ends of the posts so that the reduced diameter portions 22 of the posts are positioned in insertion portions 50 of openings 48. Followers 56 and 58 are seated in grooves 30 with the clamp member arms 46 extending perpendicularly away from the sides of top plate 26. The mounting portions 44 away from the arms project past the side of the plate. The clamp members are then pushed toward the plate to move the clamp members along axis 60 and seat the upper ends of the posts in the lock portions 52 of openings 48. Collars 24 are seated in grooves 54 to retain the clamp members on the posts 20. During seating of the clamp members on the posts the ridges 56 and 58 slide along grooves 30. When so positioned, the mounting portions 44 overly plate 26 and arms 46 extend perpendicularly away from sides 32 and 34.

During assembly of connector 10, collars 70 on the bottom of interposer assembly 62 extend into holes 80 in circuit member 16 and collars 70 on the top of assembly 62 extend into holes 78 on upper circuit member 16. The collars align the circuit members and assembly 62 so that proper connections are made between the contacts on the interposer assembly and the contact pads on the members.

With the clamp members mounted on posts 20 as described, connector 10 is closed to clamp the circuit members together against the interposer assembly and establish electrical connections between the contact pads on the two circuit members 12 and 16. The clamp members 42, cam surfaces 40 and grooves 30 and 38 form a closing connection for clamp assembly 10. Pads 76 and mats 25 and 79 are compressed.

Figure 1A:
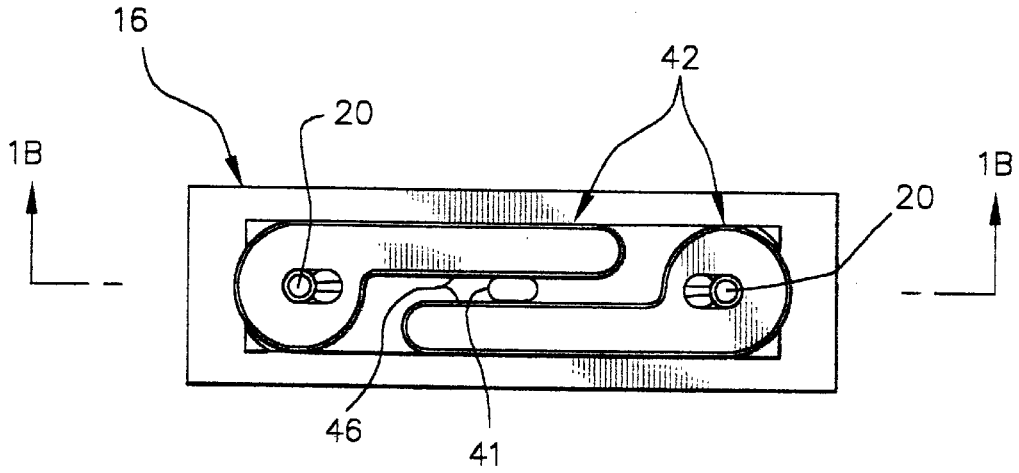
FIG. 1A is a top view of the connector assembly.
Figure 1B:
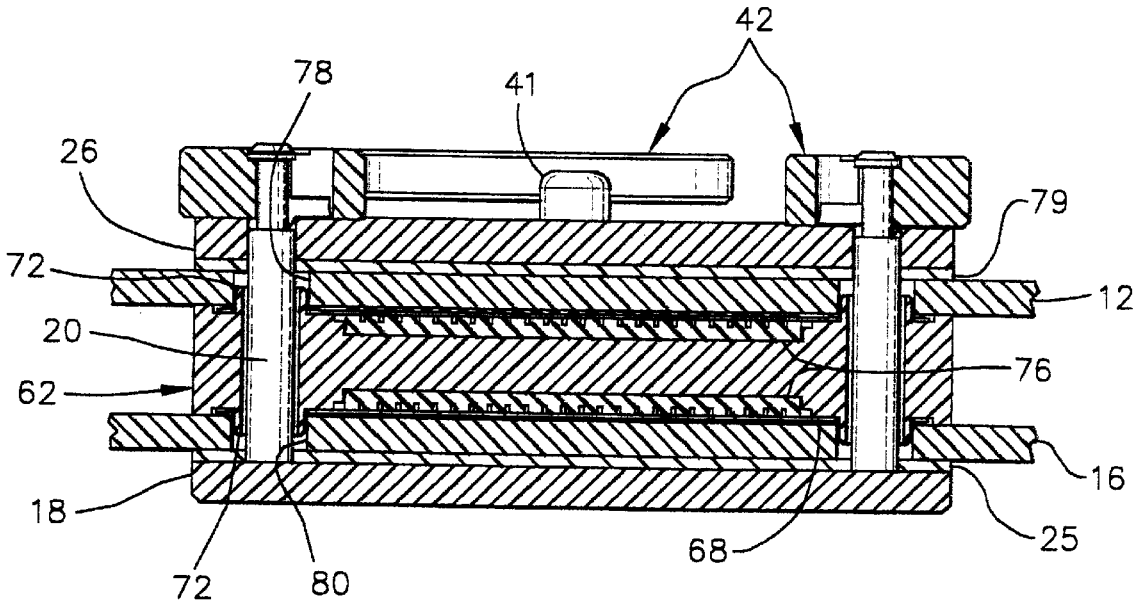
FIG. 1B is a vertical sectional view taken along line 1B—1B of FIG. 1A.
Figure 2:
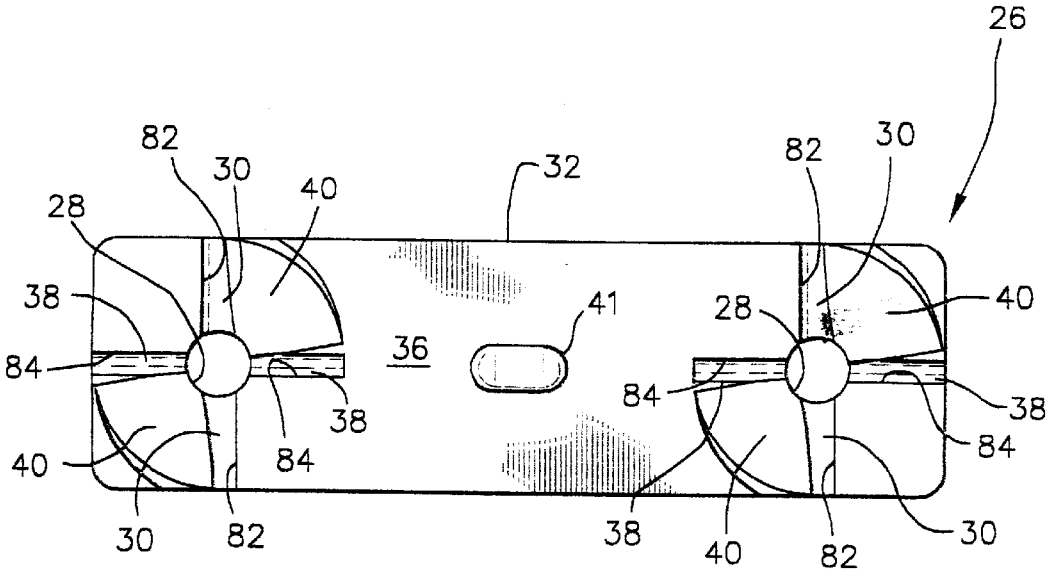
FIGS. 2 and 3 are top and side views of a top plate.

An operator closes the connector by manually engaging the outer ends of arms 46 and rotating the two clamp members clockwise 90 degrees about the respective posts 20, to the positions shown in FIG. 1A. The elongate arms 46 serve as force multipliers to facilitate manual closing of assembly 10. Rotation of the clamp members rotates the ridges or followers 56 and 58 on each member around and up cam surfaces 40 to force the top plate 26 toward bottom plate 18, compress assembly 62 and form electrical connections between the contact pads on upper and lower circuit members 12 and 16. The reduced diameter portions 22 of posts 20 have lengths along the posts greater than the thickness of top plate 26 to allow downward movement of the plate during closing of the assembly.

During closing of connector assembly 10 the top plate 26 is maintained parallel to bottom plate 18 and the components between the plates. The clamping members are squeezed together by manually engaging the ends of arms 46. These arms are equal length. Equal and opposite forces are applied to the ends of the arms by the operator so that substantially the same clamping torque is applied to each clamp member during closing. The clamp members are rotated together toward the closed position so that there is like displacement of each end of the top plate along the posts. This maintains parallel orientation of the various members of connector 10 and simultaneous formation of electrical connections between the contact pads on boards 12 and 16 and the electrical contact pads on assembly 62. The compressible pads and mats permit gradual increase of clamp pressure during 90 degree rotation of the clamp members. Gradual increase in clamp pressure reduces frictional wear between followers 56 and 58 and cam surfaces 40.

During closing of connector assembly 10 follower ridges 56, 58 of each clamp member engage the two cam surfaces 40 at each hole 28 on opposite sides of the hole. This engagement between the members and the plate, together with the close fit of the upper ends of the posts in lock portions 52 assures that the top plate does not tilt to either side of the posts.

As the clamp members are rotated to the closed position of FIG. 1A the followers 56 and 58 are moved into upper grooves 38 on plate 26 and arms 46 are moved over the top plate, to either side of projection or grip member 41. Followers 56 and 58 ride up onto the top surface of top plate 26 and are then moved over retention grooves 38 in the top plate. The compressed mats 25 and 79 expand to move the top plate 26 up rapidly to seat the followers in grooves 38. There is an accompanying audible click and vibration when the top plate engages the followers. The click and vibration provide positive signals to the operator that the assembly has been fully closed and the followers on the clamp members are locked in retention grooves 38. The compressed mats retain the followers in the grooves to prevent accidental opening of the assembly.

When closed, the mounting portions of the arms 44 are located above the ends of plate 36 and arms 46 are located above the plate on opposite sides of projection 41 to reduce the size of the closed connector yet permit ready opening of the connector by rotating the clamp members 90 degrees back to the initial position. Projection 41 prevents over rotation of the arms beyond the closed position of FIG. 1A. The projection also facilitates manual lifting and placement of the plate on the posts. When assembly 10 is closed projection 41 is below members 42 and does not increase the height of the assembly. The sides 82 of grooves 30 away from the cam surfaces 40 prevent counterclockwise rotation of the clamp members after the members are positioned on the posts. The sides 84 of grooves 38 away from cam surfaces 40 prevent clockwise rotation of the clamp members after the followers 56 and 58 have been locked in the grooves.

During rotation of each clamp member 42 about a retention post 20 the clamp member exerts a torque on the top plate tending to rotate the top plate about the retention post. The two retention posts hold the top plate in place and prevent rotation of the top plate.

Closed assembly 10 is easily opened by engaging the ends of arms 46 and rotating clamp members in a counterclockwise direction back to the positions where ridges 56, 58 are seated in grooves 30. The clamp members and top plate can then be removed from posts 20 permitting removal of circuit members 12 and 16 and interposer assembly 62.

Second embodiment clamp connector assembly 100 is shown in FIGS. 8–11 of the drawings. Assembly 100 forms electrical connections between rows of closely spaced electrical contacts 102 on the upper surface of flat circuit member 104 and rows of corresponding contacts (not illustrated) on the lower surface of flexible circuit member 106. The contacts on the flexible circuit member are located at one end of the member between two large diameter alignment holes 108 and pairs of small diameter pin holes 110. Circuit member 104 may be a circuit board, a ceramic substrate, a flexible circuit or like member. Flexible circuit member 106 may be a ribbon cable or a flexible circuit with electronic components mounted on the circuit.

Figure 8:
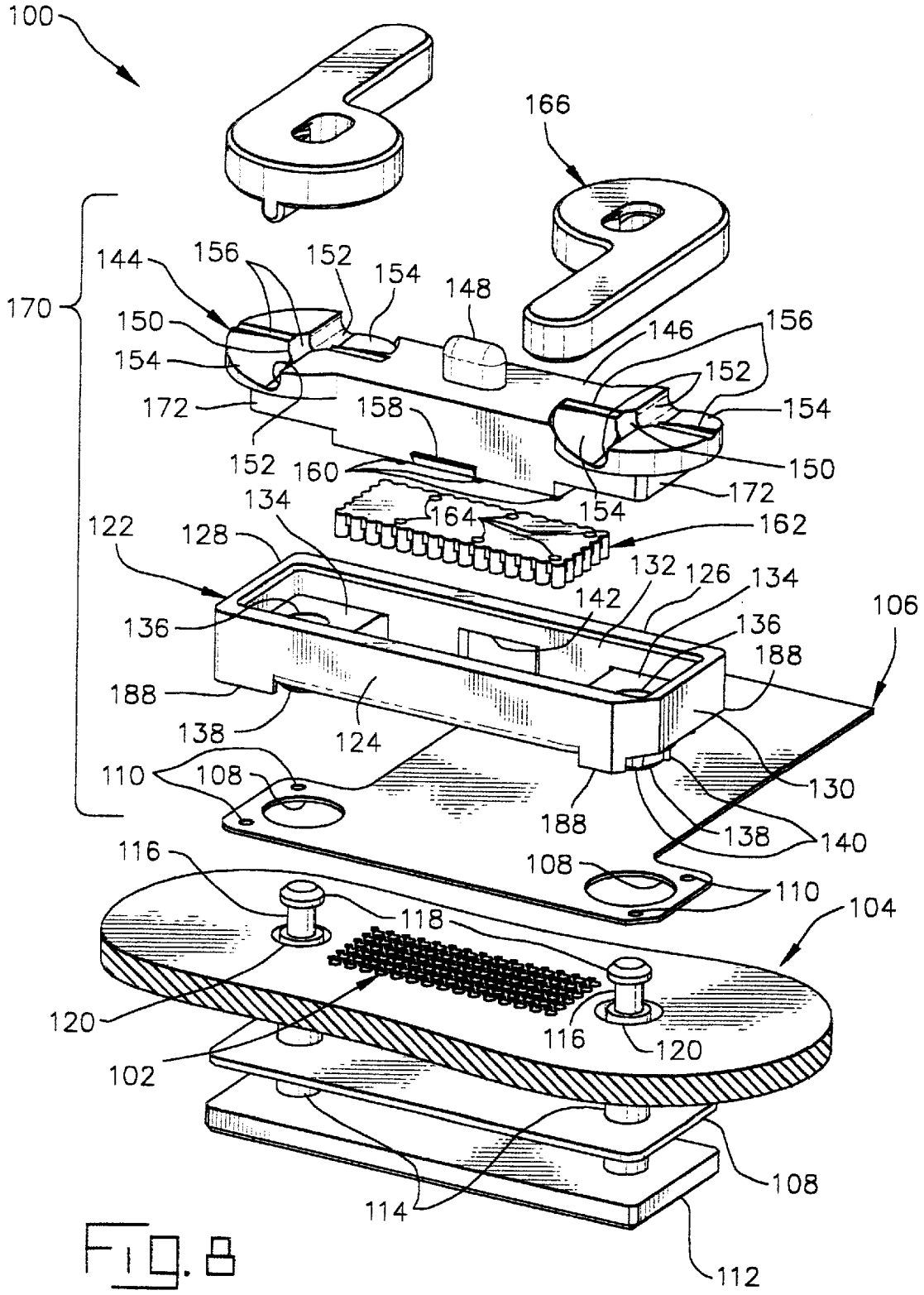
FIG. 8 is an exploded view of a second embodiment clamp connector assembly.

As illustrated in exploded FIG. 8, connector assembly 100 includes a bottom plate 112 with retention posts 114 extending upwardly from the plate. The plate and posts are like plate 18 and posts 20 of the first embodiment assembly. Reduced diameter portions 116 and end collars 118 are provided on the upper ends of the posts. Two alignment holes 120 extend through circuit member 104 to either side of contacts 102. Elongate, rectangular housing 122 is formed from insulating material, which may be molded thermoplastic resin, and includes opposed side walls 124 and 126 and end walls 128 and 130. The walls define an interior recess 132 extending from the top of the housing to the bottom of the housing at the center of the housing. The recess overlies steps 134 extending inwardly from end walls 128, 130. Cylindrical mounting passages 136 extend through steps 134. Alignment collars 138 surround the passages 136 at the bottom of housing 122. Two small diameter heat stake pins 140 are located outwardly of each alignment collar 138. In FIG. 8, the pins 140 adjacent end wall 130 are shown and the pins adjacent end wall 128 are hidden. A central, downwardly facing latch surface 142 is formed on the inner surface of each side wall 124, 126. Only one latch surface is shown in FIG. 8.

Figure 10:
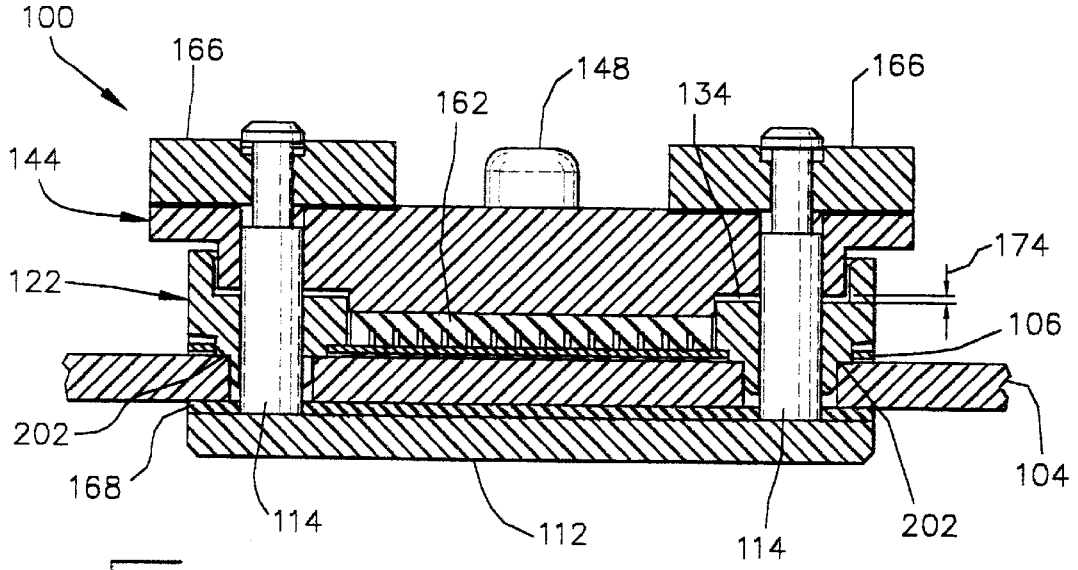
FIG. 10 is a sectional view taken along line 10—10 of FIG. 9 when the connector assembly is open.
Figure 11:
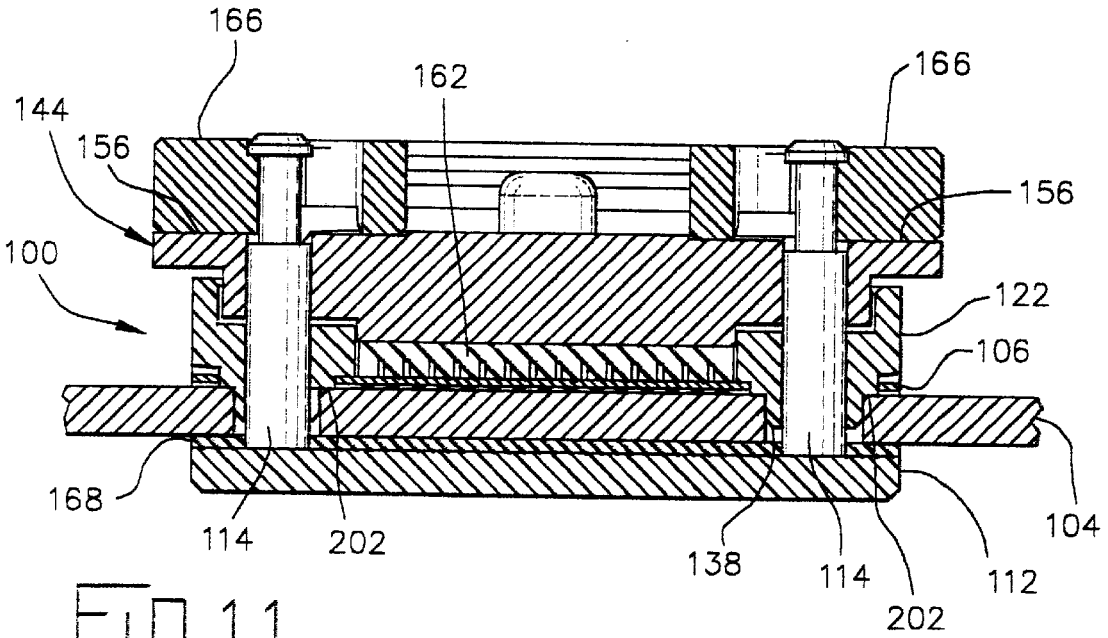
FIG. 11 is a sectional view like FIG. 10 when the connector assembly is closed.

The lower support surface of housing 122 is defined by four short legs 188 located at the lower corners of the housing and the circular surfaces 202 on alignment collars 138. When connector assembly 100 is mounted on circuit member 104 as shown in FIG. 10 and the closing members 166 are fitted on the upper ends of posts 114 with the follower members in recessed grooves 152, the lower surfaces of legs 188 and collar surfaces 202 rest on the upper surface of circuit member 104, as shown in FIGS. 10 and 11.

Top plate 144 fits within recess 132 of housing 122. The plate includes a top surface 146 and a projection or grip member 148 extending upwardly from the center of surface 146. Post holes 150 extend vertically through the opposed ends of plate 144. Recessed grooves 152, 90 degree cam surfaces 154 and upper grooves 156, like the corresponding recessed grooves 30, cam surfaces 40 and upper grooves 38 of top plate 36, are spaced around each hole 150. The cam surfaces and recessed grooves extend outwardly beyond the sides of plate 144 but do not extend beyond housing 122. A latch member 158 extends outwardly from the bottom of each side of the plate and includes an upwardly facing surface. Small diameter pins 160 extend downwardly from the central lower face of plate 144. The pins on the nearside of the plate are illustrated in FIG. 8.

Elastomer pad 162 includes a plurality of closely spaced pillars which are arranged in rows and on appropriate spacing so that when assembly 100 is closed each pillar is located above a contact on flexible circuit 106 and a corresponding contact on circuit member 104. Small diameter holes 164 are formed in the upper surface of pad 162 in the same pattern as pins 160. The pad is mounted on the central lower face of plate 144 with pins 160 extending into holes 164. A suitable adhesive may be used to secure the pad to the plate, if desired.

Assembly 100 includes a pair of clamp members 166 identical to members 42 used in the first embodiment assembly 10.

A compliance mat 168 formed of a compressible elastomer is fitted over posts 114 and rests on the top surface of bottom plate 112. The mat may be adhered to the plate by a suitable adhesive.

Plate 112, posts 114, plate 144 and clamp members 166 are preferably formed from metal. Pad 162 and mat 168 may be formed from silicone rubber.

The flexible circuit member 106, housing 122, top plate 144 and pad 162 are assembled as subassembly 170 for shipment to a customer together with the bottom plate 112 and posts 114, compliance pad 168, and clamp members 166. Subassembly 170 is assembled by mounting housing 122 on the flat proximal end of flexible circuit member 106. The upper surface of flexible circuit member 106 adjacent alignment holes 108 is seated on the lower surface of housing 122 with collars 138 extended into holes 108 and pins 140 fitted in holes 110. The pins and collars accurately align the flexible circuit member so that the pads on the flat lower surface of the flexible circuit member are in position to make electrical connections with pads on a circuit member when the subassembly is mounted on the circuit member at a customer's site. The pins 140 extend a short distance outwardly from circuit member 106. A heated tool is applied to the ends of the pins to melt the pins, deform the pins outwardly and heat stake member 106 onto the lower surface of housing 122. The collars 138 maintain proper alignment of circuit member 106 on the housing. When staked to the housing, the flexible circuit member is planar and extends across the bottom of recess 132.

Following staking of the flexible circuit member to the housing, top plate 144, with pad 162 mounted thereon as previously described, is inserted into recess 132 to position the pillars on the lower surface of pad 162 adjacent the upper surface of the flexible circuit member 106. Latches 158 snap under latch surfaces 142 to confine the top plate in recess 132. The top plate has limited vertical free play in the recess.

When the top plate 144 and pad 162 are fitted in housing 122 the steps 134 limit downward movement of the plate and the latches 158 limit upward movement of the plate in the housing. As shown in FIG. 10, when the top plate is fitted in the housing the ends of the pillars in pad 162 rest on the planar central portion of the flexible circuit member 106. The pillars are not compressed and do not bow or flex the flat circuit member downwardly. In this position, the end portions 172 of the top plate are spaced a distance 174 of about 0.020 inches above housing steps 134.

Completed subassembly 170 and the other components of connector assembly 100 are shipped to a customer's site for attachment to a circuit member. The assembly is mounted on circuit member 104, which may be a circuit board or other type of circuit member, by extending posts 114 through holes 120 in the circuit member, holes 136 in housing 122 and post holes 150 in top plate 144. The upper ends of posts 114 extend above the plate 144.

Closing of assembly 100 is completed by positioning the clamp members 166 on the upper ends of posts 114, as described previously, and then rotating the clamp members 90 degrees to move the top plate toward bottom plate 112. Initial rotation of the clamp members moves the top plate 144 down 0.020 inches to compress pad 162 and force the pillars in the pad against flexible circuit member 106. The pillars hold the contact pads on flexible circuit member 106 against the contacts on circuit member 104.

After the top plate and pad 162 have been lowered about 0.020 inches, the spacing 174 has been closed and the end portions 172 of the top plate engage steps 134 of housing 122. Further rotation of the closing members moves the followers into upper grooves 156 and compresses mat 168 without further compression of pad 162. In this way, the contact pressure forming electrical connections between the two circuit members 104, 106 is determined by the spring properties of the pad and the surfaces of the top plate 144 and housing 122 and are independent of the total clamp force between the opposing members and plate 112. The proximal end of flexible circuit 106 is supported by flat circuit member 104 during closing and is held flat, without ripples.

During closing, downward movement of the top plate is taken up first by compression of pad 162 and then, after the top plate engages the housing at steps 134, by compression of mat 168. The final clamp force is determined by the resiliency of the elastomer members without surface-to-surface contact between rigid members. Surface-to-surface contact would prohibitively increase the clamp force and induce wear on closing member followers.

During closing, clamp force is transmitted between flat circuit member 104 and housing 122 at the four spaced corner legs 188 and two collar surfaces 202. Distribution of the clamp force at different locations on circuit member 104 reduces stress on both the circuit member and housing 122 to prevent possible bending of the housing or circuit member.

Figure 9:
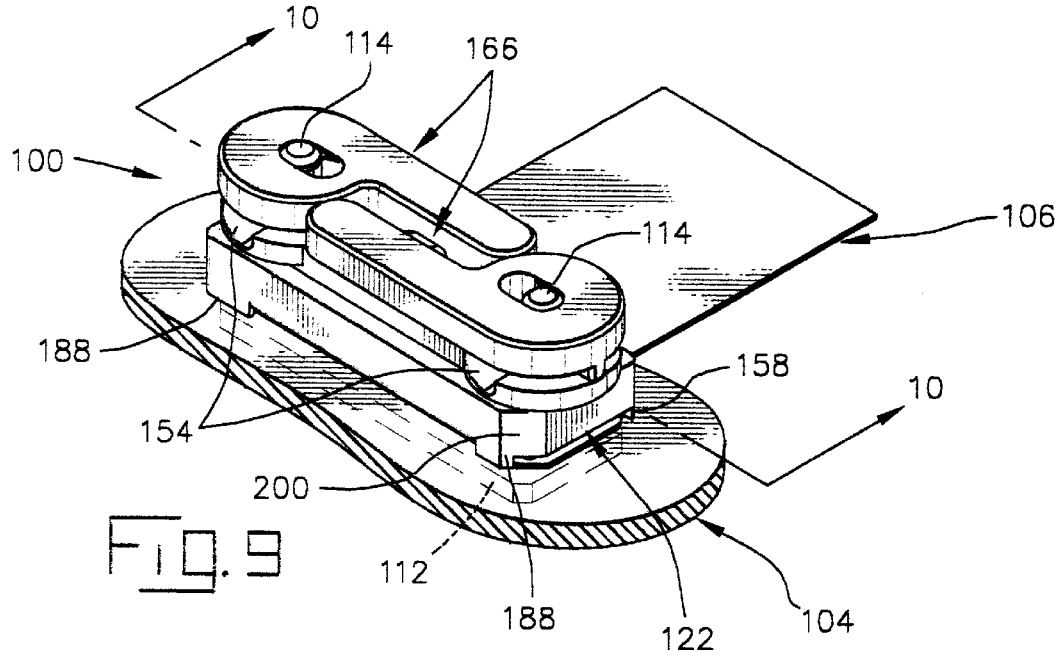
FIG. 9 is a perspective view of the second connector assembly when closed.

As shown in FIG. 9, one corner of housing 122 includes a bevel surface 200 to facilitate proper positioning of the subassembly 170 on circuit member 104. Additionally, holes 120 may have different diameters and the lower ends of alignment collars 138 may have correspondingly different diameters to assure that subassembly 170 is properly positioned on circuit member 104.

Figure 12:
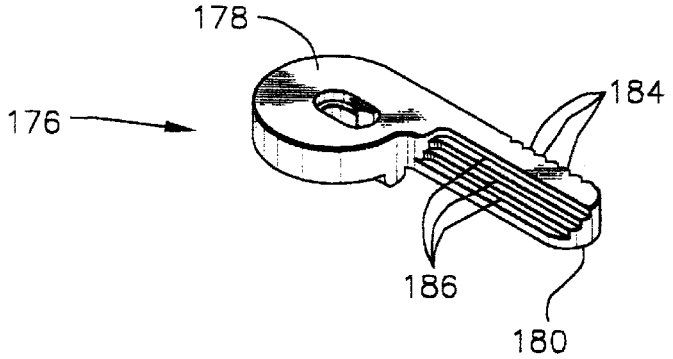
FIGS. 12 and 13 are perspective views of an alternative clamp member.
Figure 13:
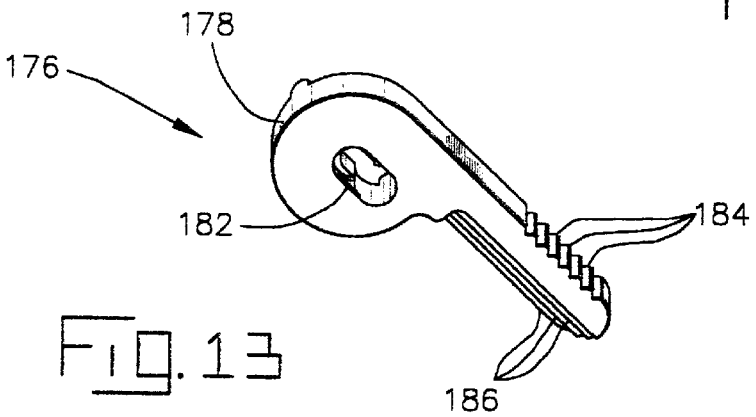

FIGS. 12 and 13 illustrate clamp member 176 which is related to clamp members 42 and 166, previously described. Clamp member 176 includes a flat mounting portion 178 identical to previously described portion 44 and an offset arm 180 extending away from the mounting portion parallel to elongate opening 182 which is like opening 48. A plurality of vertical grooves 184 are spaced along the outer side of arm 180 away from portion 178. A plurality of upwardly facing steps 186 extend along the inner side of arm 180. The steps slope upwardly at an angle from the bottom of the arm to the center of the arm, as shown in FIG. 12.

Considerable force is required to rotate the clamp members clockwise to close connector assemblies 10 and 100. The assemblies are closed by manually pushing on the outer sides of the clamp members. The vertical grooves improve frictional engagement between the operator's fingers and the clamp members as the members are rotated to close the connector assembly. The steps 186 facilitate manual opening movement of the closing members.

Considerable force is also required to rotate the clamp members of closed assembly 10, 100 counterclockwise in an opening direction and move the ridges out of the upper grooves and onto the cam surfaces. The longitudional steps 186 facilitate manual engagement with the arms for initial opening rotation of the clamp members. Opening of the assemblies is difficult because, when closed, the arms of the two mounting members are adjacent to each other, to either side of a projection and cannot be easily gripped. The recessed steps provide high friction surfaces for manual engagement and opening rotation of the members.

In both connector assemblies 10 and 100, rotation of the clamp members about the posts moves follower ridges on the members around cam surfaces formed in the top plates to move the top plates toward the bottom plates and form clamp electrical connections between circuit members positioned between the plates. It is contemplated that the positions of the cam surfaces and the follower ridges may be reversed with the cam surfaces located on the bottom of the clamp members facing the top plate and the follower ridges projecting upwardly from the top plate facing the clamp members so that rotation of the clamp members around the posts moves the cam surfaces along the follower ridges and forces the top plate toward the bottom plate. The follower ridges preferably extend across the width of the top plates to either side of the retention posts to prevent tilting during closing. The bottom surface of the clamp members would include upper grooves extending parallel to the clamp member handles in order to facilitate mounting of the clamp members on the upper ends of the retention posts projecting above the top plate and then lateral shifting of the clamp members to lock the clamp members on the posts. Rotation of the clamp members would move the cam surfaces on the members around the follower ridges to close the assembly. The cam surfaces would extend 90 degrees around the hole in the member and slope down to lower grooves.

While I have illustrated and described preferred embodiments of my invention, it is understood that they are capable of modification, and I therefore do not wish to be limited to the precise details set forth, but desire to avail myself of such changes and alterations as fall within the purview of the following claims.

What I claim as my invention:

1. A clamp connector assembly for forming electrical connections between two circuit members, the assembly including a bottom plate; a first retention post joined to the bottom plate and extending upwardly therefrom to an upper end; a top plate overlying the bottom plate, a first hole extending through the top plate, the upper end of the first retention post extending through the hole; a rotary clamp member; a first rotary connection mounting the clamp member on the upper end of the first retention post above the top plate; and an assembly closing connection between the rotary clamp member on the upper end of the retention post and the top plate, the assembly closing connection including a first cam surface on one of the clamp member and the top plate, the first cam surface extending a distance around the first retention post and having an upper end, a lower end and a sloped portion extending between the ends, and a first follower member on the other of the clamp member and the top plate, the first follower member engaging the first cam surface when the clamp member is mounted on the upper end of the first retention post, wherein rotation of the clamp member about the first retention post relatively rotates the follower member along the cam surface, shifts the top plate down toward the bottom plate and clamps two circuit members positioned between the plates together to form electrical connections between contact pads on the circuit members.

2. The clamp connector assembly as in claim 1 wherein the clamp member includes a mounting portion surrounding the upper end of the retention post and an arm extending outwardly from the mounting portion.

3. The clamp connector assembly as in claim 2 wherein the arm is offset to one side of the mounting portion.

4. The clamp connector assembly as in claim 2 wherein the arm extends outwardly from the top plate when the follower member is located at one end of the cam surface, and the arm overlies the top plate when the follower member is located at the other end of the cam surface.

5. The clamp connector assembly as in claim 2 including friction members on the arm.

6. The clamp connector assembly as in claim 1 including stop means for preventing movement of the follower member away from the cam surface.

7. The clamp connector assembly as in claim 6 wherein said stop means comprises two surfaces on the top plate.

8. The clamp connector assembly as in claim 7 including a projection grip member extending upwardly from the top plate and having a surface facing the cam surface, such grip member surface comprising one of said two surfaces.

9. The clamp connector assembly as in claim 1 wherein the assembly closing connection includes a second cam surface on said one of the clamp member and the top plate, and a second follower member on the said other of said clamp member and the top plate, the second follower member engaging the second cam surface.

10. The clamp connector assembly as in claim 9 wherein said second cam surface has an upper end, a lower end and a sloping portion extending between such ends, the lower end of the first cam surface being located across the post from the lower end of the second cam surface, and the upper end of the first cam surface being located across the post from the upper end of the second cam surface, said cam surfaces each extending the same circumferential distance around the retention post and having the same slope.

11. The clamp connector assembly as in claim 10 wherein each cam surface extends about 90 degrees around the retention post and the upper and lower ends of said surfaces extend radially outwardly from the retention post.

12. The clamp connector assembly as in claim 10 including a lower groove at the lower end of each cam surface, and an upper groove at the upper end of each cam surface, each follower member seated in a groove when the clamp connector assembly is closed.

13. The clamp connector assembly as in claim 1 wherein the clamp member includes said follower member and the top plate includes said cam surface.

14. The clamp connector assembly as in claim 1 including means for preventing rotation of the top plate during movement of the follower member along the cam surface.

15. The clamp connector assembly as in claim 14 wherein said means comprises a second retention post joined to the bottom plate and extending upwardly therefrom to an upper end; a second hole extending through the top plate, said second retention post extending through said second hole.

16. The clamp connector assembly as in claim 15 including a second rotary clamp member; a secondary rotary connection mounting the second clamp member on the upper end of the second retention post above the top plate; and a second assembly closing connection between the second rotary clamp member and the top plate.

17. The clamp connector assembly as in claim 16 wherein the first assembly connection the first cam surface is on said top plate and the first follower member is on the bottom of the first rotary clamp member; and the second assembly closing connection includes a second cam surface on the top plate and a second follower member on the bottom of the second rotary clamp member.

18. The clamp connector assembly as in claim 17 wherein each rotary clamp member includes a mounting portion surrounding a retention post and an offset arm extending away from the mounting portion, said offset arms overlying the top plate when the clamp connector assembly is closed and said arms extending outwardly of the top plate when the clamp connector assembly is open.

19. The clamp connector assembly as in claim 18 wherein the cam surfaces are located within the thickness of the top plate.

20. A clamp connector assembly for forming electrical connections between two circuit members, the assembly including a bottom plate; a pair of retention posts joined to the bottom plate and extending upwardly therefrom to upper post ends; a top plate, two post holes extending through the top plate, the upper end of each retention post extending through one of said holes; two rotary clamp members; two rotary connections, each rotary connection mounting one clamp member on the upper end of a retention post above the top plate; and an assembly closing connection between each rotary clamp member on an upper end of a retention post and the top plate, each assembly closing connection including a cam surface on one of the clamp member and the top plate, the cam surface extending a distance around a retention post, the cam surface having an upper end, a lower end and a sloped portion extending from the lower end to the upper end, and a follower member on the other of the clamp member and the top plate, the follower member engaging the cam surface, wherein rotation of the clamp members about the retention posts either rotates the follower members along the sloped portions of the cam surfaces or rotates the sloped portions of the cam surfaces past the follower members, shifts the top plate toward the bottom plate and holds two circuit members positioned between the plates together to form electrical connections between contact pads on the circuit members.

21. The clamp connector assembly as in claim 20 wherein each clamp member includes a mounting portion surrounding the upper end of a retention post and an arm extending outwardly from the mounting portion.

22. The clamp connector assembly as in claim 21 wherein each arm is offset to one side of the mounting portion and said arms extend outwardly from the top plate when the clamp connector assembly is open and said arms overly the top plate and parallel each other when the clamp connector assembly is closed.

23. The clamp connector assembly as in claim 22 including friction members on each arm.

24. The clamp connector assembly as in claim 20 wherein each assembly closing connection includes a stop preventing movement of the follower member away from the cam surface.

25. The clamp connector assembly as in claim 24 including a projection grip member extending upwardly from the top plate between the retention posts, said arms overlying the top plate to either side of the projection grip member when the connector assembly is closed.

26. The clamp connector assembly as in claim 20 wherein each assembly closing connection includes a second cam surface on said one of said clamp member and top plate and a second follower member on said other of said clamp member and top plate, the second follower member engaging the second cam surface.

27. The clamp connector assembly as in claim 26 wherein in each assembly closing connection the lower end of the first cam surface is located across a post from the lower end of the second cam surface, and the upper end of the first cam surface is located across a post from the upper end of the second cam surface, said cam surfaces extending in the same circumferential direction around the post and having the same slope.

28. The clamp connector assembly as in claim 27 wherein each cam surface extends about 90 degrees around a retention post.

29. The clamp connector assembly as in claim 27 including a lower groove at the lower end of each cam surface, and an upper groove at the upper end of each cam surface, each follower member seated in a groove when the clamp connector assembly is closed.

30. The clamp connector assembly as in claim 20 wherein each clamp member includes a follower member and the top plate includes said cam surfaces.

31. The clamp connector assembly as in claim 30 wherein said cam surfaces are located within the thickness of the top plate.

32. The clamp connector assembly as in claim 20 including an elastomer member on one of said plates.

33. The clamp connector assembly as in claim 32 wherein said elastomer member comprises a elastomer pad having a plurality of pillars.

34. The clamp connector assembly as in claim 20 including an interposer assembly including an insulating body having opposed ends, a mounting passage extending through each end of the insulating body, top and bottom surfaces located between said passages and facing said top and bottom plates respectively, a first plurality of contacts on the top surface, a second plurality of contacts on the bottom surface, and electrical connections between respective contacts on said top and bottom surfaces, and elastomer members biasing said contacts on each side of the body against a circuit member, said interposer assembly located between said bottom and top plates with the retention posts extending through said mounting passages.

35. The clamp connector assembly as in claim 1 including an opening extending through the clamp member, the opening having an insertion portion moveable over the upper end of the retention post and a lock portion engageable with the upper end of the retention post.

36. The clamp connector assembly as in claim 35 including a collar on the upper end of the retention post and wherein the lock portion includes a surface facing away from the bottom plate, said surface engageable with the collar.

37. The clamp connector assembly as in claim 36 wherein said surface extends more than 180 degrees around the post to lock the post in the lock portion.

* * * * *